United States Patent [19]

Ylla

[11] Patent Number: 4,972,304

[45] Date of Patent: Nov. 20, 1990

[54] LIGHTING SYSTEM

[76] Inventor: Robert N. Ylla, 1794 Hawthorn Ave., College Park, Ga. 30337

[21] Appl. No.: 521,527

[22] Filed: May 10, 1990

[51] Int. Cl.[5] ..... A45C 15/06

[52] U.S. Cl. ..... 362/156

[58] Field of Search ..... 362/154, 155, 156

[56] References Cited

U.S. PATENT DOCUMENTS 3,800,134 3/1974 Castaldo ..... 362/155

FOREIGN PATENT DOCUMENTS 2078924 1/1982 United Kingdom ..... 362/156

*Primary Examiner*—Carroll B. Dority

*Attorney, Agent, or Firm*—B. J. Powell

[57] ABSTRACT

A handbag having a liner and an outer shell. A flexible mounting member is attached to the liner between the outer shell and liner. A switch, light and battery are attached to the flexible mounting member. The switch and light extend through the flexible mounting member and liner into the interior of the handbag whereby the switch may be activated to activate the light for lighting the interior of the handbag.

11 Claims, 1 Drawing Sheet

LIGHTING SYSTEM

BACKGROUND OF THE INVENTION

1. Field of the Invention

This invention relates generally to lighting devices and more particularly to lighting devices for use in a handbag, purse, backpack, or other similar container, for the illumination of the interior of the container and of the articles therein.

2. Description of the Prior Art

Prior lighting devices for containers such as purses, handbags and the like have been suggested. These lighting devices are usually bulky and have rigid enclosures. This is a problem due to the limited area available within purses, handbags and the like. This is also a problem because it limits the flexibility and usefulness of the container. It is often impossible for the carrier of such a container to readily make use of the utility of such a device.

Another common problem with prior devices of this type is that it is often necessary to unduly alter the purse, handbag, or other similar container to affix such a device. Such alterations often result in extensive damage to the container.

Examples of prior lighting devices are set forth in the following U.S. Pat. Nos.:

| U.S. Pat. No. | Issued | Inventor |
|---|---|---|
| 1,183,268 | 5/16/16 | M. S. Baldwin |
| 2,179,214 | 11/7/39 | O. Hallbauer |
| 2,558,606 | 6/26/51 | J. W. Crockett |
| 2,611,573 | 9/23/52 | J. C. Young |
| 4,091,443 | 5/23/78 | H. Ohrenstein |

SUMMARY OF THE INVENTION

These and other problems associated with the prior art overcome by the invention disclosed herein by providing a lighting device for a container which is sufficiently compact so as not to interfere with the use of the container. Further, the invention is flexible so that it does not interfere with the flexibility of the container.

An object of this invention is to provide a compact lighting device for use in a handbag, purse, or other similar container for the illumination of the articles therein. Such compactness allows the use of this invention in a wider variety of such containers and minimizes the destructive alteration of such containers.

Another object of this invention is to provide a lightweight lighting device for this use. Such lightweight construction will serve to minimize the additional weight added to said container by the inclusion of the device disclosed herein. Such lightweight construction is valuable since such containers are often carried for long periods of time either by hand, or over the user's shoulder and any excessive weight simply compounds the discomfort of so carrying such a container.

A further object of this invention is to provide a flexible lighting device for this use. Such flexible construction minimizes the rigidity of such containers added by the invention. Such flexible construction also serves to minimize the amount of space necessary for the use of the invention. Such reduction in necessary space is valuable in that the usable space in the container is maximized so that the invention may thereby be utilized in a wider selection of containers.

These and other features and advantages of the invention will become more apparent upon consideration of the following detailed description and accompanying drawings wherein like characters of reference designate corresponding parts throughout the several views and in which:

Figure 1:
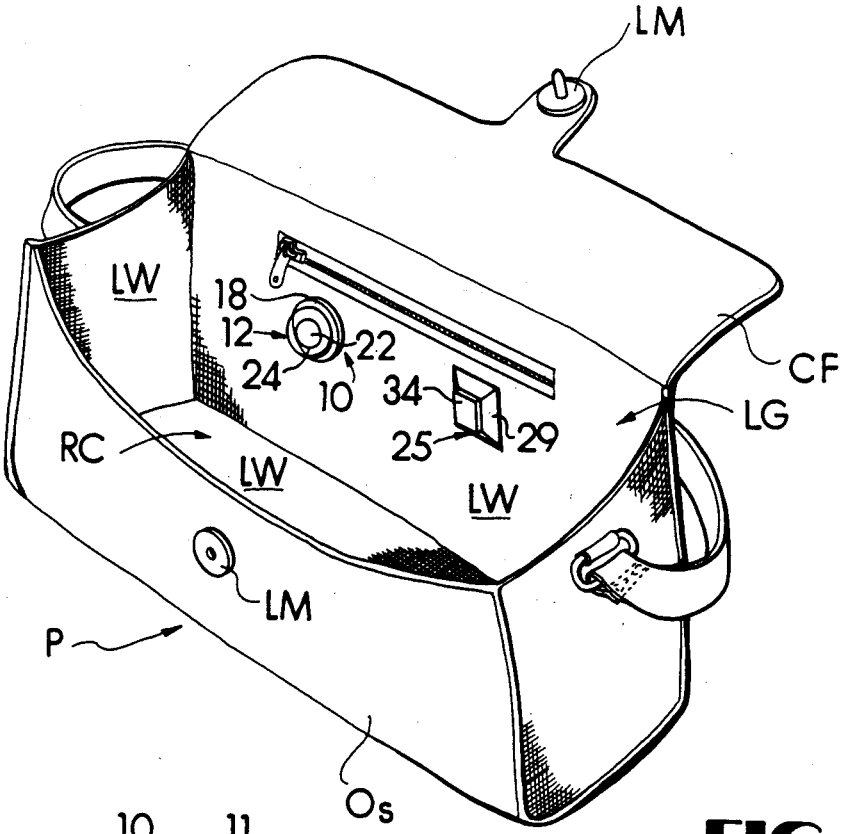
FIG. 1 is perspective view of the invention installed in a purse.
Figure 2:
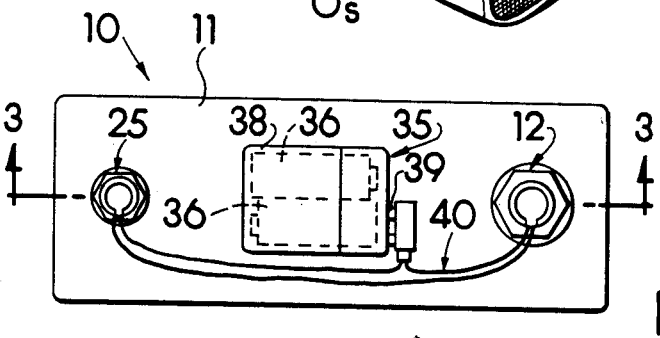
FIG. 2 is a rear view of the invention.

These figures and the following detailed description disclose specific embodiments of the invention, however, the inventive concept is not limited thereto since it may be embodied in other forms.

DETAILED DESCRIPTION OF ILLUSTRATIVE EMBODIMENTS

Referring to the drawings, the invention is incorporated in a purse P which has an outer shell OS with a lining LG covering the inside of the outer shell OS so as to form an article receiving cavity RC therein. An appropriate closure flap CF is provided to close the cavity RC. Since the lining LG is attached to the outer shell OS around the edges thereof, an enclosed space ES is defined between the outer shell OS and the lining LG. The invention makes use of this enclosed space ES to keep the invention from intruding into the article receiving cavity RC as will become more apparent. The lining LG is formed in the particular purse P shown by a plurality of lining walls LW.

The light unit 10 of the invention includes a base member 11 on which is mounted a light emitting assembly 12. The light emitting assembly 12 is controlled by a switch assembly 25 which is also mounted on the base member 11.

The base member 11 is a relatively thin planar member having a size such that it will fit in the enclosed space ES in the purse P. Typical thicknesses for base member 11 are 1/16–1/8 inch. The base member 11 is made out of a flexible material such as plastic or fiberboard although other materials can be used. The base member 11 is typically attached to the exterior of the lining wall LG with which it is associated by any conventional means such as adhesives or sewing. The lining wall LG defines a pair of spaced apart openings $O_L$ and $O_S$ therethrough at the locations at which the light emitting assembly 12 and the switch assembly 25 are to project through the lining LG. The base member 11 likewise defines a pair of holes $H_1$ and $H_2$ therethrough which align with the openings $O_L$ and $O_S$ respectively.

The light emitting assembly 12 may have different constructions without departing from the scope of the invention. For purposes of illustration, the light assembly 12 is shown as a light base 15 which has a threaded section 16 thereon which is sized to pass through the aligned opening $O_L$ and hole $H_1$ so that the major portion of the base 15 is located outside the lining wall LW within the enclosed space ES in the purse P as best seen FIG. 3. The light base 15 includes a locating flange 18 on that end within the article receiving cavity RC larger in diameter than the opening $O_L$ which cooperates with the nut 19 and lock washer 20 to mount the base 15 on the base member 11 and lining wall LW by clamping the base member 11 and lining wall LW therebetween. The base 15 is provided with appropriate connections 21 for connection to an electrical power source to operate same.

Figure 3:
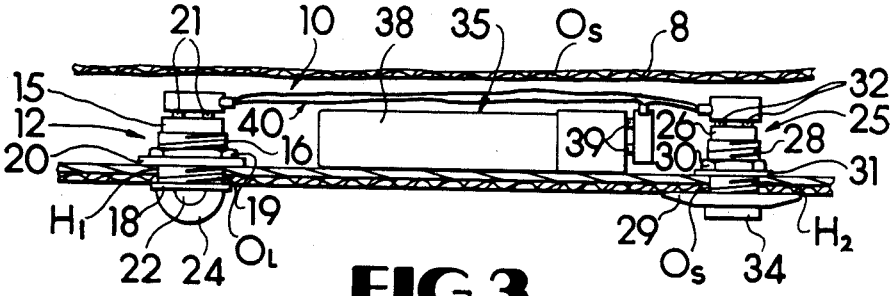
FIG. 3 is an enlarged cross-sectional view taken along line 3—3 in FIG. 2.

The light emitting assembly 12 mounts a conventional light bulb 22 therein as best seen in FIG. 3. A light transmitting lens 24 is removeably mounted on the end of the base 15 in the cavity RC to transmit the light from the bulb 22 into the cavity RC to illuminate the articles in the cavity RC.

The light emitting assembly 12 is controlled by a switch assembly 25 which is mounted in the aligned opening $O_S$ and hole $H_2$ through the lining wall LW and the base member 11. The switch assembly 25 is of conventional construction with a switch body 26 that defines a threaded section 28 thereon adapted to fit through the opening $O_S$ and hole $H_2$ as best seen in FIG. 3. The switch base 26 includes a locating flange 29 on that end within the article receiving cavity RC larger in diameter than the opening $O_S$ which cooperates with the nut 30 and lock washer 31 to mount the body 26 on the base member 11 and lining wall LW by clamping the base member 11 and lining wall LW therebetween. The body 26 is provided with appropriate connections 32 for connection to an electrical power source and the light emitting assembly 12 to operate same. The switch assembly 25 has a switch actuator 34 which projects into the cavity RC so as to be accessible to the user to operate the invention.

A battery pack 35 is mounted on the base member 11 in the enclosed space ES to power the light emitting assembly 12. The battery pack 35 is of conventional design and should be as small as possible to minimize the interference with the use of the purse. The battery pack illustrated includes a pair of replaceable batteries 36 which are received in a case 38 mounted on the base member 11. Appropriate electrical connections 39 are provided for connection to the light emitting assembly 12 and the switch assembly 25 for the battery pack 35 to selectively power the light emitting assembly 12.

A wiring harness 40 is provided to connect the battery pack 35, light emitting assembly 12 and the switch assembly 25. The wiring harness 40 makes the connections in such a way that the switch assembly 25 controls the operation of the light emitting assembly 12.

It will be appreciated that the light emitting assembly 12 may be combined with either or both the switch assembly 25 and the battery pack 35 without departing from the inventive concept. The wiring harness 40 may also be incorporated in the base member 11 to simplify the mounting and connection of the components. By having separate components, however, the flexibility of the entire assembly is maximized.

It will likewise be understood that the switch assembly 25 may have alternate arrangements. For instance, the switch assembly 25 can be incorporated in the latch mechanism LM seen in FIG. 1 so as to activate the light emitting assembly 12 when the purse P is opened and to turn off the light emitting assembly 12 when the purse P is closed and the mechanism LM closed.

What is claimed as invention is:

1. A light for illuminating the interior of a container such as a handbag, purse, backpack or the like defining a cavity therein and which includes a flexible wall defining at least a portion of said cavity comprising:

a flexible mounting member positioned on said flexible wall exteriorly of said cavity;

a light emitting assembly mounted on said mounting member, at least a portion of said light emitting assembly projecting through said flexible wall into said cavity in said container to project light from said light emitting assembly into said cavity; and, switch means located exteriorly of said flexible wall and including manually engageable actuation means projecting through said flexible wall into said cavity in said container, said switch means operatively connected to said light emitting assembly to control same in response to manual manipulation of said actuation means.

2. The light of claim 1 wherein said container includes an outer shell and wherein said flexible wall serves as a lining to said outer shell so as to define an enclosed space between said wall and said outer shell; and wherein said mounting member, said light emitting assembly and said switch means are located in said enclosed space.

3. The light of claim 2 further including:

battery means located in said enclosed space between said flexible wall and said outer shell, said battery means mounted on said flexible mounting member operatively connected to said light emitting assembly and said switch means to selectively power said light emitting means in response to the operation of said switch means.

4. The light of claim 1 further including:

battery means located exteriorly of said flexible wall and mounted on said flexible mounting member operatively connected to said light emitting assembly and said switch means to selectively power said light emitting means in response to the operation of said switch means.

5. The light of claim 1 wherein said flexible wall and flexible mounting member define aligned openings therethrough; and wherein said light emitting means further includes:

a base;

means for engaging said flexible wall and said flexible mounting member about said aligned openings and for engaging said base to mount said base on said flexible mounting member;

a light bulb mounted in said base for projecting light from said light bulb into said cavity to illuminate same.

6. The light of claim 5 wherein said light emitting means further includes a light transmitting member projecting into said cavity through said aligned openings for transmitting the light from said light bulb into said cavity to illuminate same.

7. The light of claim 2 wherein said flexible wall and flexible mounting member define aligned openings therethrough; and wherein said light emitting means further includes:

a base located in said enclosed space;

means for engaging said flexible wall and said flexible mounting member about said aligned openings and for engaging said base to mount said base on said flexible mounting member;

a light bulb mounted in said base; and a light transmitting member projecting into said cavity through said aligned openings for transmitting the light from said light bulb into said cavity to illuminate same.

8. A light for illuminating the interior of a container such as a handbag, purse, backpack or the like defining a cavity therein and which includes an outer shell and a flexible wall defining at least a portion of said cavity wherein said flexible wall serves as a lining to said outer shell so as to define an enclosed space between said wall and said outer shell comprising:

a flexible mounting member positioned in the enclosed space;

a light emitting assembly mounted on said mounting member with at least a portion of said light emitting assembly projecting through said flexible wall into said cavity in said container to project light from said light emitting assembly into said cavity, said light emitting means including:

a base located in said enclosed space and extending through said mounting member and said flexible wall into said cavity, means for engaging said flexible wall and said flexible mounting member and said base to mount said base on said flexible mounting member, a light bulb mounted in said base and a light transmitting member projecting into said cavity for transmitting the light from said light bulb into said cavity to illuminate same;

switch means located exteriorly of said flexible wall and including manually engageable actuation means projecting through said flexible wall into said cavity in said container; and, battery means located in said enclosed space between said flexible wall and said outer shell, said battery means mounted on said flexible mounting member and operatively connected to said light emitting assembly and said switch means to selectively power said light emitting means in response to the operation of said switch means.

9. A light assembly for illuminating the interior of a container such as a handbag, purse, backpack or the like defining an article receiving cavity therein, said light assembly comprising:

a flexible mounting member connected to said container in said cavity and defining an enclosed space subdivided from said cavity, said flexible mounting member defining an opening therethrough connecting said cavity and said enclosed space; and, a light emitting unit mounted on said flexible mounting member and extending through said opening in said flexible mounting member, said light emitting unit including:

a base located in said enclosed space and extending through said flexible mounting member into said cavity;

means for engaging said flexible mounting member and said base to mount said base on said flexible mounting member;

a light bulb mounted in said base for emitting light into said cavity; and switch means including manually engageable actuation means located in said cavity in said container to activate said light emitting unit.

10. The light assembly of claim 9 wherein said light emitting unit further includes:

replaceable battery means operatively associated with said light bulb through said switch means to selectively power said light emitting means in response to the operation of said switch means, said battery means accessible within said enclosed space defined by said flexible mounting member.

11. The light assembly of claim 10 wherein said light emitting unit further includes:

a light transmitting member over said light bulb projecting into said cavity for transmitting the light from said light bulb into said cavity to illuminate same.

* * * * *